US011124922B1

(12) United States Patent
Janson

(10) Patent No.: US 11,124,922 B1
(45) Date of Patent: Sep. 21, 2021

(54) TIE WRAP-AROUND FOR TIE PLATE SECUREMENT

(71) Applicant: Paul M Janson, Northridge, CA (US)

(72) Inventor: Paul M Janson, Northridge, CA (US)

( * ) Notice: Subject to any disclaimer, the term of this patent is extended or adjusted under 35 U.S.C. 154(b) by 0 days.

(21) Appl. No.: 16/928,111

(22) Filed: Jul. 14, 2020

Related U.S. Application Data

(60) Provisional application No. 62/922,405, filed on Aug. 7, 2019.

(51) Int. Cl.
*E01B 9/02* (2006.01)
*E01B 9/40* (2006.01)

(52) U.S. Cl.
CPC . *E01B 9/02* (2013.01); *E01B 9/40* (2013.01)

(58) Field of Classification Search
CPC ..... E01B 9/00; E01B 9/02; E01B 9/04; E01B 9/28; E01B 9/30; E01B 9/64
See application file for complete search history.

(56) References Cited

U.S. PATENT DOCUMENTS 928,276 A * 7/1909 Ogden ..... 238/314
1,611,977 A * 12/1926 Wilson, Sr. ..... E01B 9/64 238/314
1,624,555 A * 4/1927 Curtis ..... E01B 9/64 238/314
1,675,993 A * 7/1928 Askie ..... E01B 9/64 238/314
1,779,212 A * 10/1930 Hasse ..... E01B 9/46 238/333
2,397,750 A * 4/1946 Preston ..... 238/314
2,454,454 A * 11/1948 Hughes ..... 238/314
4,050,284 A 9/1977 Miller
4,073,435 A 12/1978 Miller
4,141,500 A 2/1979 Gragnani
4,349,151 A 9/1982 Schumaker
4,350,291 A 9/1982 Dobson
4,413,777 A 11/1983 Brown
4,513,912 A 4/1985 Schumaker
4,756,477 A 7/1988 Schumaker
9,702,091 B2 7/2017 Coats

* cited by examiner

*Primary Examiner* — Robert J McCarry, Jr.
(74) *Attorney, Agent, or Firm* — Stan Collier, Esq.

(57) ABSTRACT

The tie plates, normally, made of steel, have a wrap-around device that gives additional support. The wrap-around device goes around or partially the tie and takes various forms as such. It may be a U-shaped bracket with the top section welded to the tie plate. The vertical legs extend beyond the bottom of the tie and have a bolt between the bottoms of the legs. The brackets may be further secured to the tie by lag screws. The tie plate would still have conventional spikes. In another embodiment, it may be shaped as a metal box that is attached to the tie plate by welding with bolts or lag screws in the sides of the box. The design of these devices transfers weight vertically as well as sideways from the wheels. If the ties are made of concrete, the box design allows the concrete to flow therethrough.

15 Claims, 12 Drawing Sheets

TIE WRAP-AROUND FOR TIE PLATE SECUREMENT

CROSS REFERENCES TO RELATED APPLICATIONS

The following application is the utility application from the provisional application Serial No. 62/922,405 filed Aug. 7, 2019 and entitled, "Railroad tie plates using elastic rail fasteners" by the same inventor Paul M. Janson and is incorporated herein.

REFERENCE TO FEDERALLY SPONSORED RESEARCH OR DEVELOPMENT

NA

REFERENCE TO JOINT RESEARCH AGREEMENTS

NA

REFERENCE TO SEQUENCE LISTING

NA

BACKGROUND OF THE INVENTION

Field of the Invention

The present invention relates to railroad tracks, and, more particularly, relates to ties used to hold the rail tracks in place, and, in great particularity, relates to securing the rails by tie plates having E-clips thereon or other devices such as spikes and bolts.

Description of the Prior Art

Typically trains travel on rails that are placed on ties, usually wood, but can be concrete. The rails are held to the ties by spikes, usually, that are placed about the rail with the rail sitting on tie plates. Other securing devices may be nut and bolt and e-clips. The large amount of vibrations from trains, up and down, and sideways, cause the rails to become loose, and may result in derailments.

One of the present day devices for holding rails securely are e-clips inserted into the tie plates. The Pandrol Company has developed and patented numerous versions of the e-clip as shown in the following patents: U.S. Pat. Nos. 9,702,0911; 4,7516,477; 4,513,912; 4,412,777; 4,349,151; 4,350,291; 4,141,500; 4,073,45; and 4,050,254 are all incorporated by reference as to their teachings.

Accordingly, there is a need for a device and method for securing the tie plate to the road tie to insure non-separation.

SUMMARY OF THE INVENTION

The present invention provides a device and method for providing additional securement of the tie plate to the tie. Conventionally, the tie plates are secured to the ties by conventional spikes as noted in U.S. Pat. No. 9,702,091. Due to the extreme forces involved when a train travels over the rail, the spikes may work loose allowing the rails to separate to cause a derailment. The tie plates, normally, made of steel, will have a wrap-around device that gives additional support. The wrap-around device goes around the tie or even through the tie and takes various forms as such. It may be a U-shaped bracket with the top section welded to the tie plate. The vertical legs extend beyond the bottom of the tie and have a bolt between the bottoms of the legs. The brackets may be further secured to the tie by lag screws. The tie plate would still have conventional spikes or spike screws. In another embodiment, it may be shaped as a metal box that is attached to the tie plate by welding or a mechanical attachment with bolts or lag screws in the sides of the box. The design of these devices transfers weight vertically as well as sideways from the wheels. If the ties are made of concrete, the box design allows the concrete to flow therethrough.

An object of the present invention is to provide a tie wrap-around connected to the tie plate for providing additional support both vertically and horizontally of the present invention.

It is another object of the present invention to provide a tie wrap-around that is an integral part of the tie plate of the present invention.

It is a further object of tie present invention to provide a tie wrap-around that provides multiple embodiments for the present invention.

It is still a further object of the present invention to provide a tie wrap-around for wooden, plastic, composite, recycled rubber or concrete ties of the present invention.

It is yet a further object of the present invention to provide a tie wrap-around that may be attached pre-installation of the tie to the rail of the present invention.

It is yet a further object of the present invention to provide a tie wrap-around that uses horizontal Dolts and lag screws for the additional support.

It is yet a further object of the present invention to provide a tie wrap-around that uses horizontal bolts and for the additional support without the use of conventional spikes.

These and other objects, features, and advantages of the present indention will become more readily apparent from the attached drawings and the detailed description of the preferred embodiments, which follow.

BRIEF DESCRIPTION OF THE DRAWINGS

Like reference numerals refer to like parts throughout the several views of the drawings.

DETAILED. DESCRIPTION OF THE PREFERRED EMBODIMENTS

The tie plates for supporting a rail, normally, made of steel, will have a wrap-around device that gives additional support. The wrap-around device goes around or partially the tie and takes various forms as such: It may be a U-shaped bracket with the top section welded to the tie plate. The vertical legs extend beyond the bottom of the tie and have a bolt between the bottoms of the legs. The brackets may be further secured to the tie by lag screws. The tie plate would still have conventional spikes. In another embodiment, it may be shaped as a metal box that is attached to the tie plate by welding or mechanical attachment with bolts or lag screws in the sides of the box. These embodiments transfer weight vertically as well as sideways from the wheels. If the ties are made of concrete, the box design allows the concrete to flow therethrough.

Figure 1A:
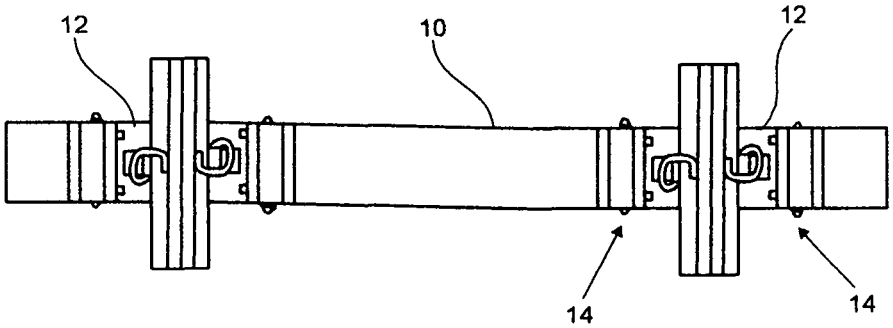
FIGS. 1A, 1B, 1C and 1D show various partial views of a tie with tie plates with a pair of U-shaped wrap-around devices with a bolt under the tie.
Figure 1B:
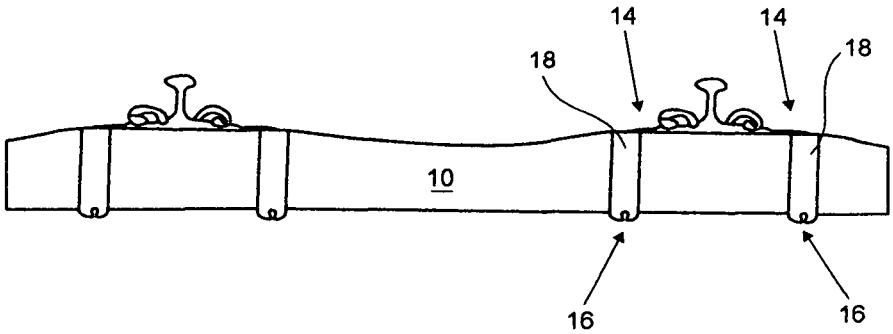
Figure 1C:
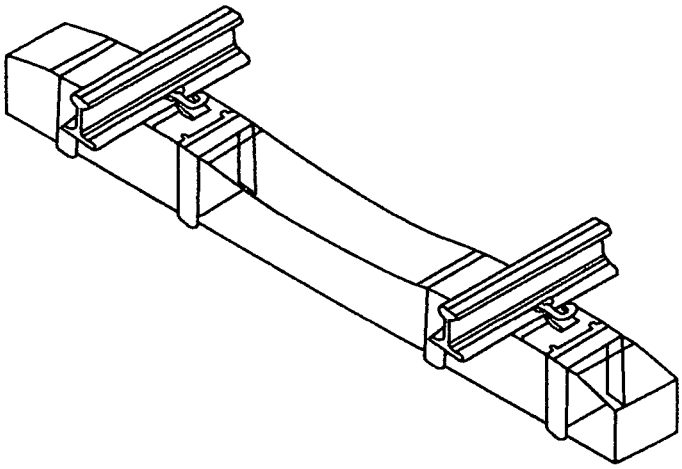
Figure 1D:
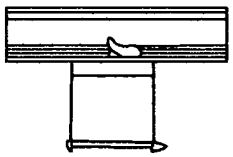

FIG. 1A shows a top partial view of a tie 10 with tie plates 12 with a pair of U-shaped wrap-around devices 14. FIG. 1B shows a side view with a bolt and nut 16 at the bottom of the legs 18. FIG. 1C is a perspective view. FIG. 1D is a cross-sectional view looking parallel to the tie 10. The device 14 is fixedly attached by welding or other mechanical means to an e-clip tie plate 12. The tie may be wooden, plastic, composite, or even recycled rubber or concrete.

Figure 2A:
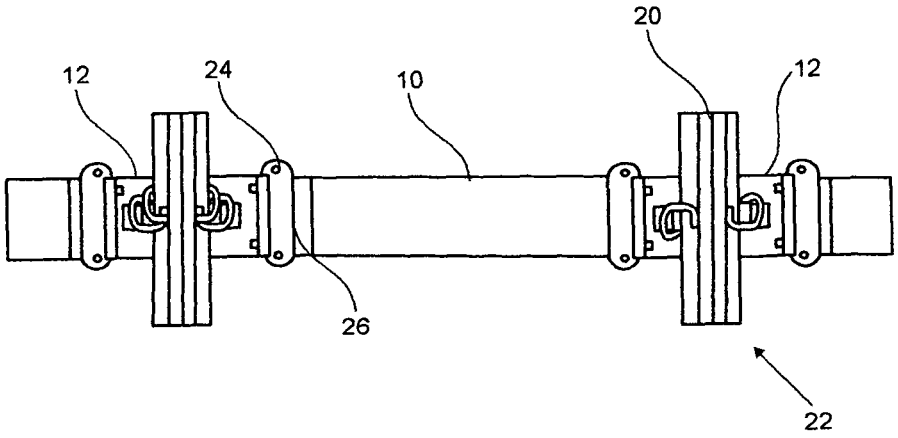
FIGS. 2A, 2B, 2C and 2D show various partial views of a rail on a tie with tie plates with a pair of horizontal brackets having connecting bolts for each.
Figure 2B:
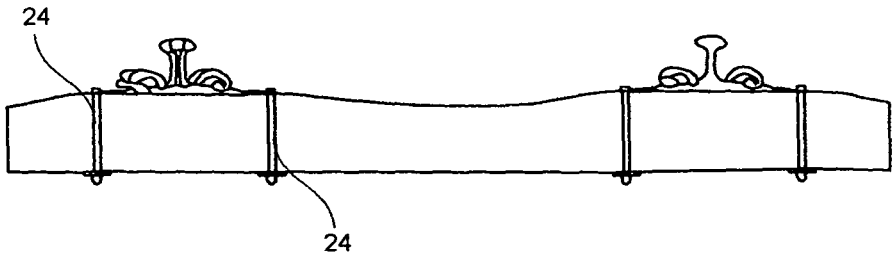
Figure 2C:
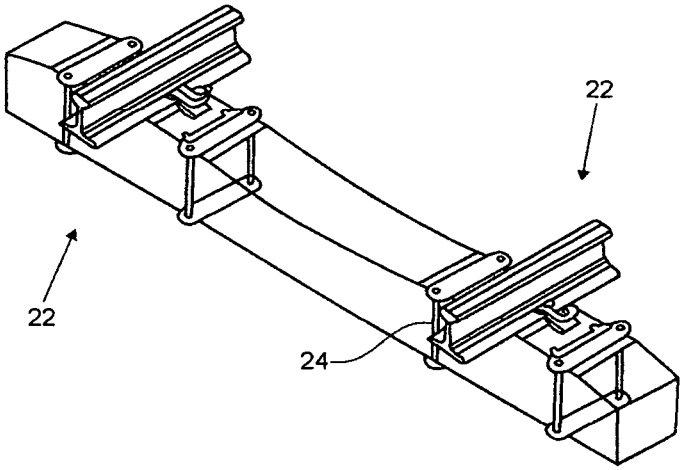
Figure 2D:
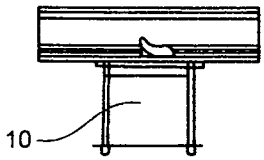
Figure 3C:
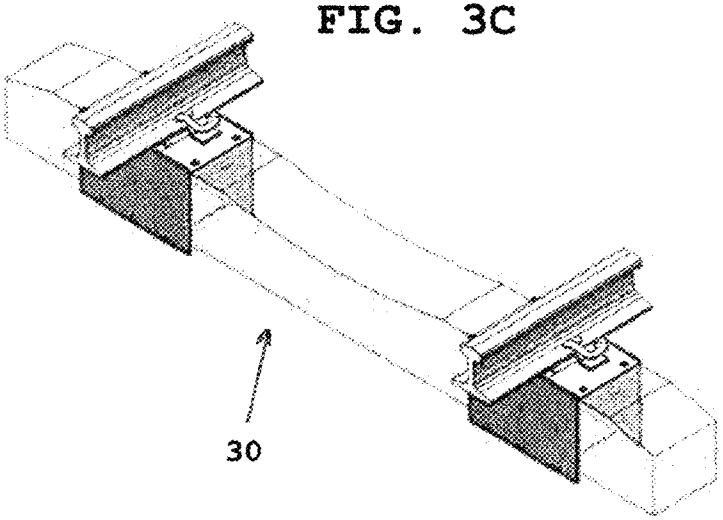
FIGS. 3A, 3B, 3C and 3D show various partial views of a rail on a tie with tie plates with a pair of U-shaped flanges integrated to the plates with bolts under the tie.

FIG. 2A shows various partial views of a rail 20 on a tie 10 with tie plates 12 with a pair of horizontal brackets devices 22 having a pair of connecting vertical bolts 24 for each that may be through the tie plate 12. The brackets 26 are fixedly attached to the tie plate 12 by welding or other mechanical means as is well known in the art. FIG. 2B shows a side view of the bolts 24. FIG. 3C is a perspective view and FIG. 2D is a cross-sectional view along the tie 10.

Figure 3D:
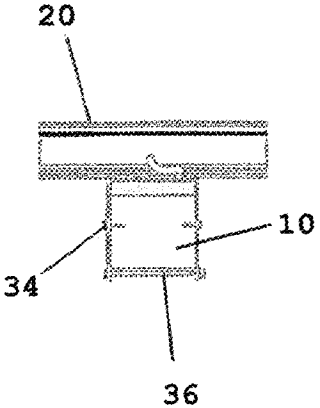
Figure 3A:
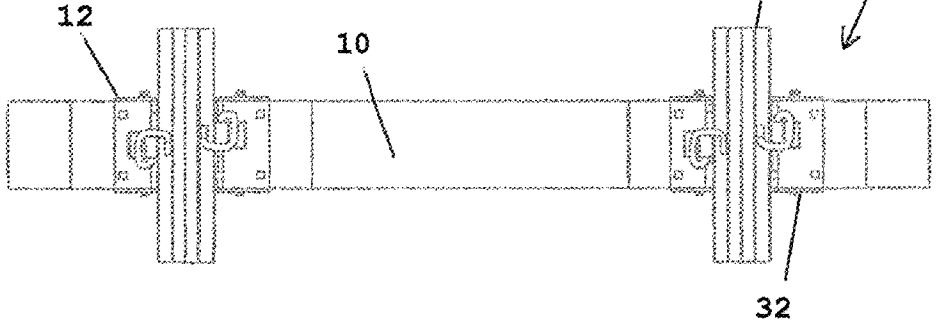
Figure 3B:
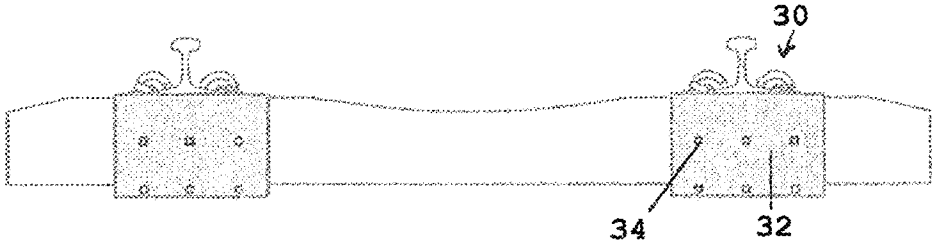

FIG. 3A shows a partial top view of a rail 20 on a tie 10 with tie plates 12 with a pair of U-shaped flanges 30 integrated to the tie plates by welding or other mechanical means with bolts under the tie and lag screws 34 in the side flanges 32. FIG. 3B is a side view of the flange side plates 32 having a length about that of the tie plate 12. FIG. 3C is a perspective view of the same. FIG. 3D an end view of the same better showing of the under bolts 36 and lag screws 34.

Figure 4C:
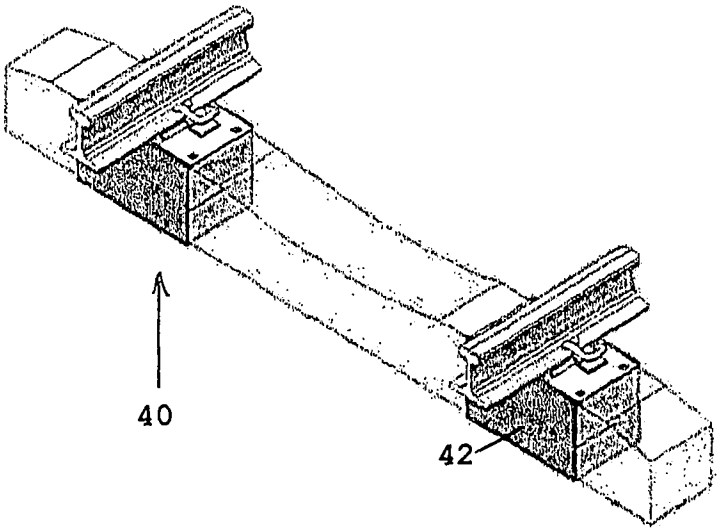
FIGS. 4A, 4B, 4C and 4D show various partial views of rail on a tie with tie plates with a box attached to each tie plate.
Figure 4A:
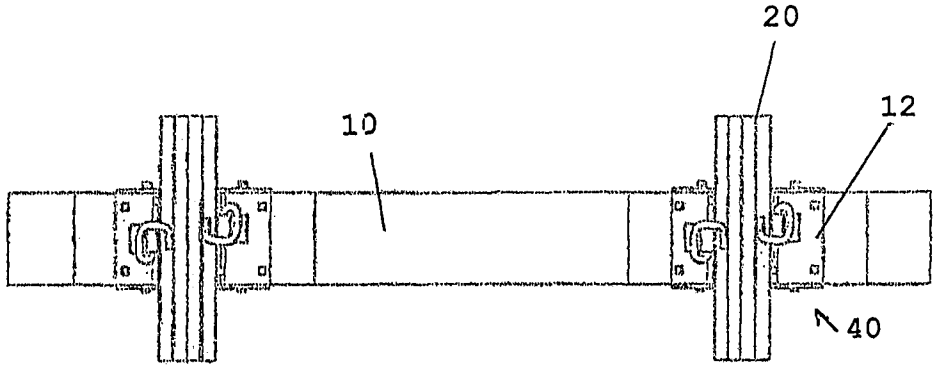
Figure 4B:
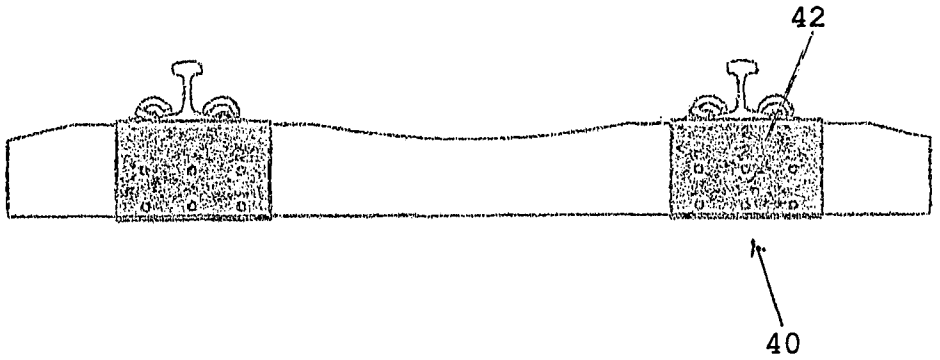
Figure 4D:
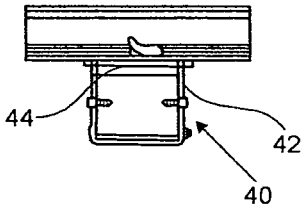

FIG. 4A shows a partial top view of a rail 20 on a tie 10 with tie plates 12 with a wrap-around box 40 attached to each tie plate 12. The vertical wall 42 of FIG. 4B has a length about that of the tie plate 12. FIG. 4C shows a perspective view of the wrap-around box 40. The tie plates 12 can sit upon the top wall 44 as shown in FIG. 4D. The wrap-around box 40 may be made from square tubing and cut to length. Each of the devices shown are installed on the ties during manufacturing.

Figure 5C:
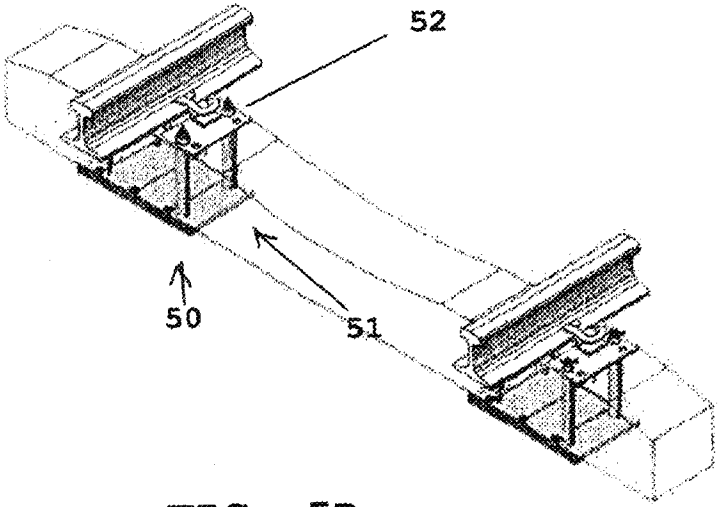
FIGS. 5A, 5B, 5C, 5D, and 5E show various partial views of a rail on a tie with tie plates and a top plate with four support studs connected to a bottom plate.
Figure 5D:
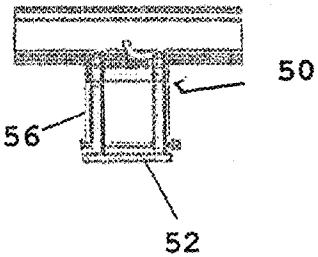
Figure 5A:
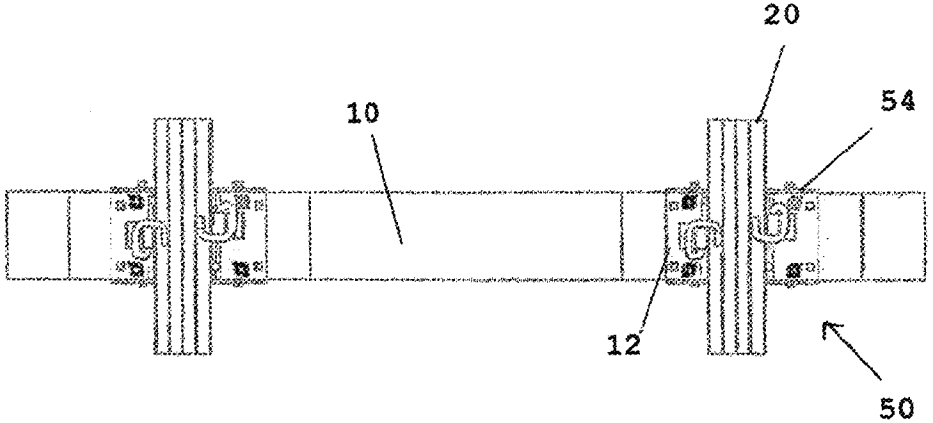
Figure 5B:
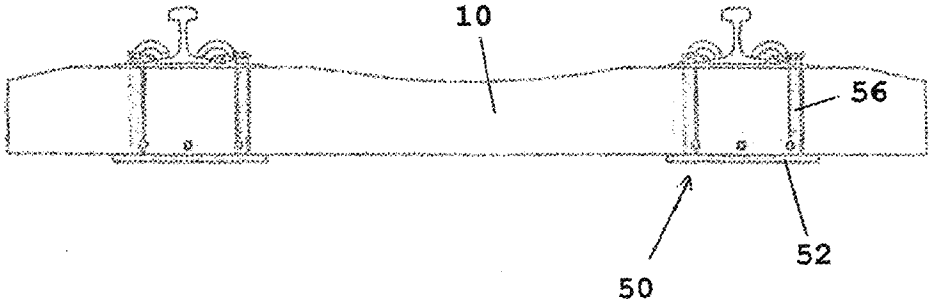
Figure 5E:
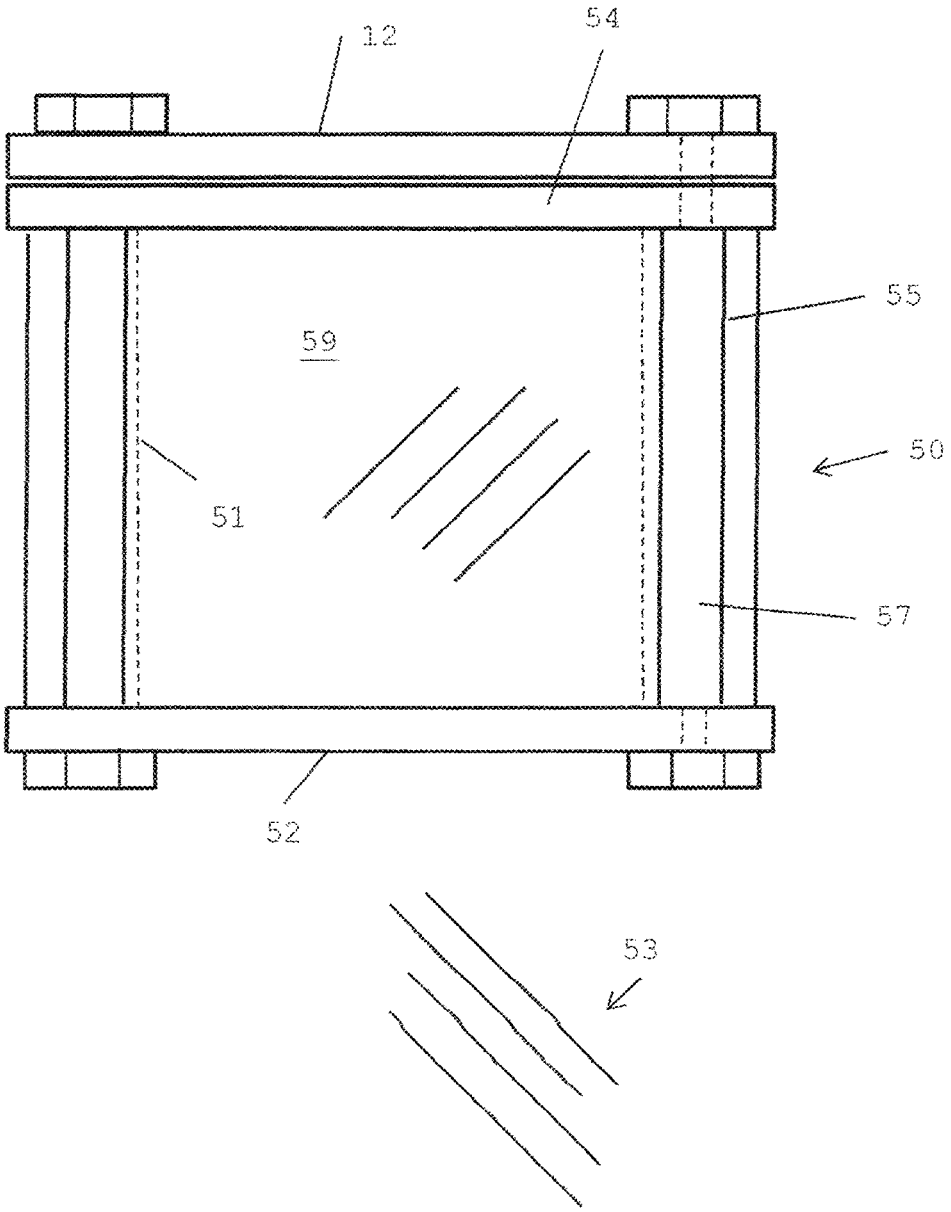

FIG. 5A shows a partial views of a rail 20 on a tie 10 with a tie plates 12 per ail. A stud de; rice 51 has four support studs 50 between a bottom plate 52 and the tie plate 12. Additionally, a top plate 54 is connected to the tie plate 12 being on the top thereof by welding or mechanical means. The top plate 54 may be omitted. Four support studs 50 or fewer are connected between the tie plate 12 and the bottom plate 52. If the top plate 54 is used, the studs 50 would go through that into the tie plate 12. The studs 50, being four as shown, may be connected between the tie plates 12 and the bottom plate 52 by nuts on the stud bolts. They may be further secured by wires through the nuts for additional securement. The studs 55 have a larger diameter 57 in the central portion to better support the tie 10 and rails 20. The top and/or bottom of the stud is reduced in diameter to provide a seat to top plate 54, or tie plate 12, and/or the bottom plate 52. The tie 10 is sitting on the gravel road bed 53. See FIG. 5E, FIG. 5B shows a side view and the studs 56 on the side of the tie 10. FIG. 5C is a perspective view and FIG. 5D is a cross sectional end view as is FIG. 5E. In a different version, FIG. 5E, the studs 55 can be placed within the concrete tie 59, Further the studs 55 can also be outside the tie 59 as shown by the dotted lines 51. The studs 55 could be used for wood, plastic, etc.

Figure 6C:
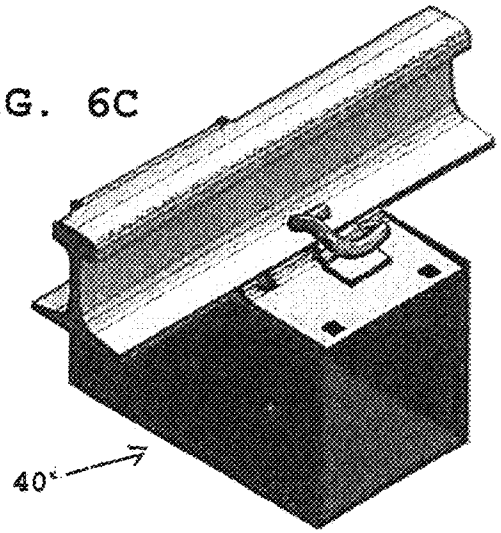
FIGS. 6A, 6B, 6C, 6D and 6E show various partial views of a rail on a tie with the tie plate attached to a square tube box.
Figure 6D:
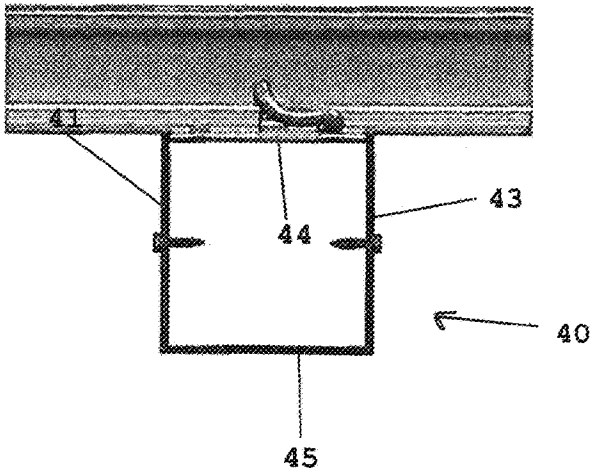
Figure 6A:
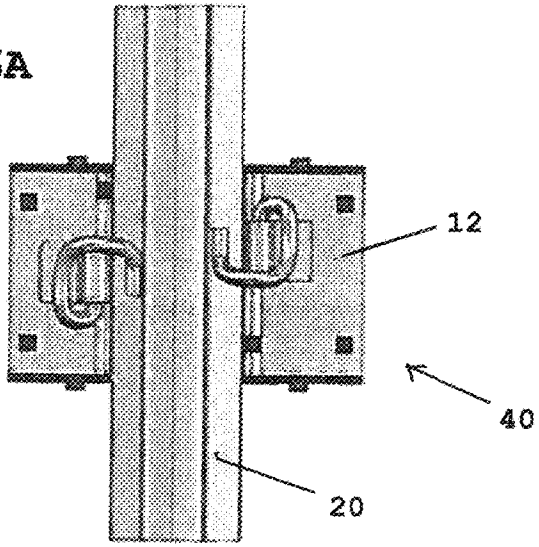
Figure 6B:
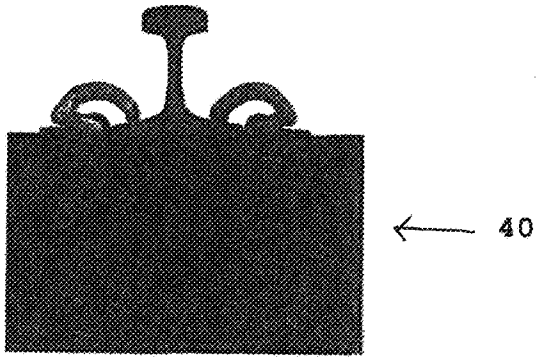
Figure 6E:
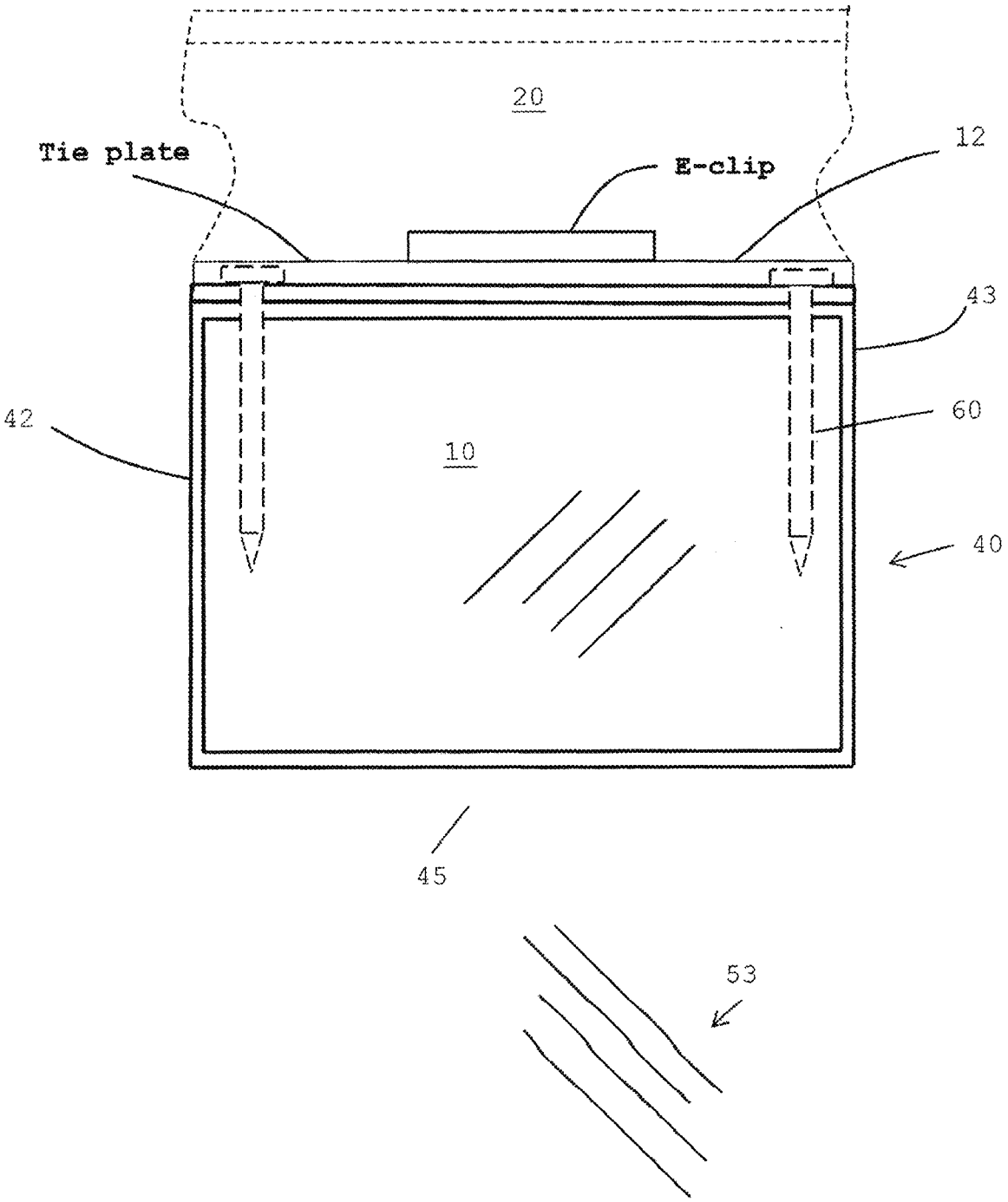

FIG. 6A shows a partial top view of a rail 20 on a tie 10 with the tie plates 12 attached to a square box 40. The tie plate 12 is attached to the top 47 of the side walls 41 and 43 attached thereto by welding or mechanical means. The bottom wall 45 of FIG. 6D is a side view; FIG. 6C is a perspective view, and FIGS. 6D and 6E is a cross sectional end view. The tie 10 sits on the railroad bed 53. Normally, both the tie plate 12 and the top wall 47 have four aligned holes 62 for spikes 60.

Figure 7:
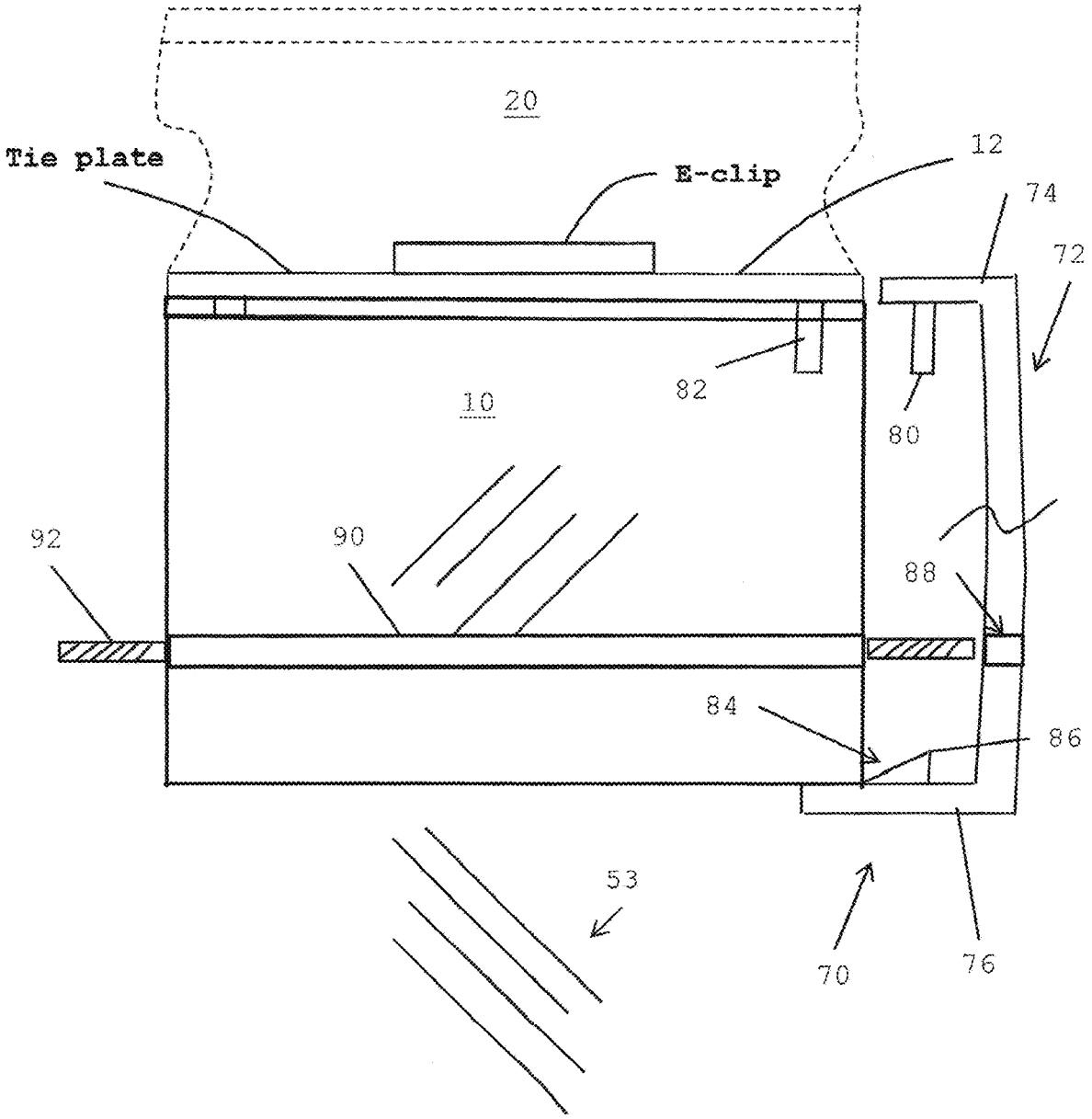
FIG. 7 is a variant of the invention shown in FIG. 3 where a locking side plate is secured to the tie plate without spikes and with one or more horizontal bolts.

Referring to FIG. 7, a variant of the invention shown in FIG. 3 is shown. A locking side plate 72 or flange is shaped like a U with a top leg 74 and a bottom leg 76 integrally attached to the side wall 78. The top leg 74 has a pin 80 that goes into a spike hole 82 in the tie plate 12, there being four spike holes in this embodiment. The bottom leg has a claw 84 with a peak 86 facing outward. The side wall 78 has a bolt hole 88 that aligns with a bolt hole 90 in the tie 10, whether wood, plastic, or concrete. The side wall 78 may be curved outwards away from the tie 10. To install, the pins 80 are inserted into the spike holes 82. Then a hammer or other device hits the outer surface of the side wall 78 driving the claw 84 under the tie. The locking side plate 70 is flexible. To further insure that the plates 70 remain firmly attached, a bolt 92 is pushed through the bolt hole 90 and 88 and secured with a nut that may be spot welded onto the plate 70. This embodiment is extremely secure and further deletes the requirement for spikes.

The present invention is generally directed at a railroad tie wrap-around device for securement of the tie plate to prevent derailment from wear and tear to the tie plate and ties. The amount of forces both vertically and laterally and repeatedly is almost, too difficult to calculate when a 100 car coal train moves along tracks. It is therefore very necessary to construct and reinforce the present ties and tie plates when replaced, thus wrap-around device for securing the tie plate to the railroad tie provides additional support both vertically and horizontal to the tie plate. In this regard, several embodiments are considered sufficient to provide an enhanced structure, such as (1) a pair of U-shaped brackets fixedly attached to a tie plate, a top bracket section said U shape, bracket fixedly secured to the tie plate on sides parallel to a rail, and a securing bolt attached to vertical legs of the U-shaped bracket at a bottom, said securing bolt passing under the tie. (FIG. 1); (2) a pair of brackets, a top bracket fixedly attached to the tie plate, a bottom bracket under the tie, and securing bolts attached to ends of the pair of top and bottom brackets (FIG. 2); (3) a pair of side flanges fixedly secured to the sides of the tie plate perpendicular to the rail, said flanges being substantially in length to the tie plate, securing means for holding the side flanges to the tie plates to the tie; and wo or more threaded rods across the bottom of the tie and into the side flanges (FIG. 3); (4) a tie plate box with the tie plate fixedly attached to a top wall of the tie plate box, the four walls of the box integrally formed; and two or more rod screws passing through the side walls of the plate box; wherein if the tie is pre-stressed concrete, the tie wrap-around becomes an integrated part of the tie plate. (FIG. 6); (5) a tie plate to fixedly attached to one or more studs, wherein the studs have a reduced diameter through the tie plate, and a bottom plate having said studs mounted therein. (FIG. 5); wherein a nut locking system would be used on the studs.

To implement the above invention, a method of securing railroad tracks, comprises: having a railroad tie before installation in a track; fixedly attaching a wrap-around device to the tie plate; laying the ties with the wrap-around device in the track; and fixedly attaching the track to the tie. The ties are composed of a material selected from the group of wood, plastic, composite, recycled rubber, and concrete. Also the wrap-around device is welded to the tie plate. And also, including securing the wrap-around device by spikes, nut and bolts, and lag screws to the ties. Further if the concrete is pre-stressed, the tie box is positioned in a device such as jig before the concrete is poured so any securing devices are enclosed in the concrete in proper positions.

Since many modifications, variations, and changes in detail can be made to the described embodiments of the invention, it is intended that all matters in the foregoing description and shown in the accompanying drawings be interpreted as illustrative and not in a limiting sense. This, the scope of the invention should be determined by the appended claims and their legal equivalents.

What is claimed is:

1. A railroad tie wrap-around for securement of a tie plate wherein the tie plate uses e-clips, said railroad tie wrap-around comprising:

a wrap-around device for securing the tie plate to the railroad tie by welding or spikes or nuts and bolts or a combination to the tie plate and providing additional support both vertically and horizontal to the tie plate.

2. The railroad tie wrap-around device as defined in claim 1, further including:

a pair of U-shaped brackets fixedly attached to a tie plate having e-clips, a top bracket section of said U-shaped bracket fixedly secured to the tie plate on sides parallel to a rail, and a securing bolt attached to vertical legs of the U-shaped bracket at a bottom, said securing bolt passing under the tie.

3. The railroad tie wrap-around device as defined in claim 1, said railroad tie wrap-around device further including:

a pair of brackets, a top bracket fixedly attached to the tie plate, a bottom bracket under the tie, and securing bolts attached to ends of the pair of top and bottom brackets.

4. The railroad tie wrap-around device as defined in claim 3, wherein said top bracket is welded to the tie plate.

5. The railroad tie wrap-around device as defined in claim 1, further including a pair of side flanges fixedly secured to the sides of the tie plate perpendicular to the rail, said flanges being substantially in length to the tie plate, securing means for holding the side flanges to the tie plates to the tie; and two or more threaded rods across the tie and into said side flanges.

6. The railroad tie wrap-around as defined in claim 5, further including as securing means being spikes and screws placed through holes in the flanges into the tie.

7. The railroad tie wrap-around for securement as defined in claim 5, further including a U-shaped locking side plate having a top leg and a bottom leg, said top leg having two or more spike hole pins and the bottom leg having two or more claws, said claws engaging the bottom surface of said tie, and two or more bolts with nuts for holding the side plates to said tie.

8. A railroad tie wrap-around for securement of a tie plate wherein the tie plate uses e-clips, said railroad tie wrap-around comprising:

a rail tie plate, said rail tie plate being secured by e-clips to a rail thereon;

a wrap-around device for securing the tie plate to the railroad tie by welding or spikes or nuts and bolts or a combination to the tie plate and providing additional support both vertically and horizontal to the tie plate;

said wrap-around being a tie plate box with the tie plate removably fixed to a top wall of said tie plate box, the walls of the tie plate box integrally formed.

9. The railroad tie wrap-around device as defined in claim 8, further including a tie plate box with the tie plate fixedly attached to a top wall of said tie plate box, the walls of the box integrally formed;

two or more rod screws passing through the side walls of the plate box;

two or more spikes passing through the tie plate and top wall of said tie plate box;

wherein if the tie is pre-stressed concrete, said tie wrap-around becomes an integrated part of the concrete and the tie plate.

10. The railroad tie wrap-around for securement as defined in claim 9, further including pre-stressed concrete ties.

11. The railroad tie wrap-around as defined in claim 9, wherein said tie plate box is formed from square tubing.

12. The railroad tie wrap-around for securement as defined in claim 8, further including a tie plate, said tie plate fixedly attached to the top wall; and side walls of said tie plate box having no bottom wall thereon.

13. The railroad tie wrap-around for securement comprising:

a wrap-around device for securing a tie plate to a railroad tie by welding or spikes or nuts and bolts to the tie plate and providing additional support both vertically and horizontal to the tie plate using e-clips, spikes, nut and bolts, W-clip plate assembly to secure the rail to the tie plate; further including:

the tie plate fixedly attached to one or more studs, wherein the studs have a reduced diameter through the tie plate to provide a seat thereto; and a bottom plate having said studs mounted therein.

14. The railroad tie wrap-around for securement as defined in claim 13, further including a top plate fixedly attached to one or more studs, wherein the studs have a reduced diameter through the tie plate, and said top plate fixedly attached to the tie plate.

15. The railroad tie wrap-around device as defined in claim 14, wherein a nut locking system is used on the studs.

* * * * *